US006259011B1

(12) United States Patent
Liao

(10) Patent No.: US 6,259,011 B1
(45) Date of Patent: Jul. 10, 2001

(54) CYMBAL CLAMP

(75) Inventor: Tsun-Chi Liao, Taichung (TW)

(73) Assignee: Hwa Shin Musical Instrument Co., Ltd., Taichung (TW)

( * ) Notice: Subject to any disclaimer, the term of this patent is extended or adjusted under 35 U.S.C. 154(b) by 0 days.

(21) Appl. No.: 09/553,055

(22) Filed: Apr. 20, 2000

(51) Int. Cl.[7] ..... G10D 13/02
(52) U.S. Cl. ..... 84/421; 84/422.3; 84/327
(58) Field of Search ..... 84/422.3, 327, 84/421, 422.1, 422.2

(56) References Cited

U.S. PATENT DOCUMENTS 4,158,981 * 6/1979 Kurosaki ..... 84/421
6,096,956 * 8/2000 Hoshino ..... 84/421

* cited by examiner

*Primary Examiner*—Shih-Yung Hsieh
(74) *Attorney, Agent, or Firm*—Bacon & Thomas, PLLC

(57) ABSTRACT

A cymbal clamp provided to pinch a cymbal or a cymbal set at top end of a shank comprises an upper and a lower movable clamping piece extendable to a predetermined angle, a center post provided with a plurality of cotton washers and separation pieces as well as a spring, and a barrel pivot rod transversely loaded in two semi-circular concavities with inside ratchet teeth in the upper clamping piece or inside grooves in the lower clamping piece. By abovesaid construction, stepless adjustment of the cymbal's inclination angle can be made easily just by loosening a wing nut under the lower clamping piece, and fastening the same after adjustment.

3 Claims, 7 Drawing Sheets

CYMBAL CLAMP

BACKGROUND OF THE INVENTION

This invention relates generally to a musical instrument, more particularly, it relates to an adjustable cymbal clamp for rapid stepless adjustment of cymbal's inclination angle.

To build a band requires a variety of musical instruments, such as drums, electronic organs, guitars, etc, and an additional cymbal set is usually joined to the drums to provide more distinct rhythm. As shown in FIG. 1, an adjustable cymbal clamp (shown in FIG. 2) attached on a shank mainly comprises a first and a second clamp body, wherein a ratchet ring is arranged in the inner wall of the first clamp body, and a plurality of ratchet pieces is protrusively formed in the inner face of the second clamp body for engaging the ratchet pieces with the ratchet ring. The combined clamp bodies are fixed to become a unity by axially penetrating a fixing element through them, and moreover, a sleeve is disposed at the bottom end of the second clamp body for sleeve jointing with the shank.

When adjusting the inclination angle of the cymbal (or cymbal set) fastened by the abovesaid conventional clamp is desired, a user has to unlock the fixing element firstly, then he can separate those two clamp bodies slightly and disengage the ratchet ring and the ratchet pieces to swivel one of the clamp bodies to a desirable angle and lock the fixing element again. The ratchet engagement method is good for positioning purpose though, it is the ratchet engagement that doesn't fit for stepless adjustment and occasionally lead to inaccurate positioning. Moreover, the ratchet teeth are liable to wear away in case those clamp bodies are not separated completely when torque is applied.

In view of abovesaid defects, after years of constant effort in research, the inventor of this invention has consequently developed and proposed an improved mechanism pertaining to the subject matter.

SUMMARY OF THE INVENTION

The primary object of this invention is to provide a convenient lever-operational stepless adjustment manner for regulation of inclination angle of cymbal.

Another object of this invention is to provide an adjustable cymbal clamp with simple adjustment assembly in relatively lower cost.

In order to realize abovesaid objects, this invention comprises an upper and a lower movable clamping piece extendable to a predetermined angle, a center post provided with a plurality of cotton washers and separation pieces as well as a spring, and a barrel pivot rod transversely loaded in two semi-circular concavities with inside ratchet teeth in the upper clamping piece or inside grooves in the lower clamping piece. By abovesaid construction, stepless adjustment of the cymbal's inclination angle can be made easily just by loosening a wing nut under the lower clamping piece, and fastening the same after adjustment.

For more detailed information regarding this invention together wit further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
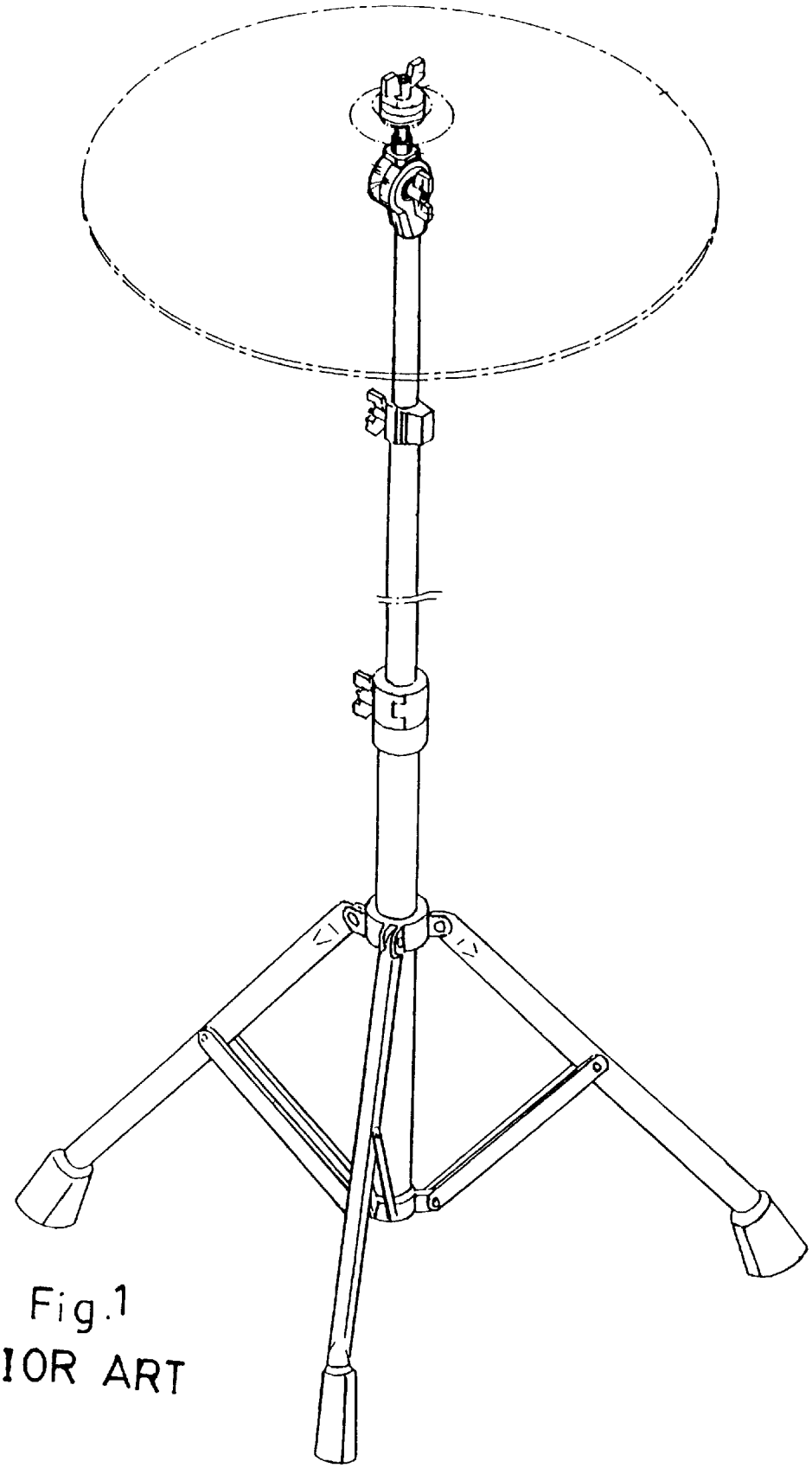
Fig.1 PRIOR ART
FIG. 1 is an elevational view of a conventional cymbal stand in three dimensions.
Figure 2:
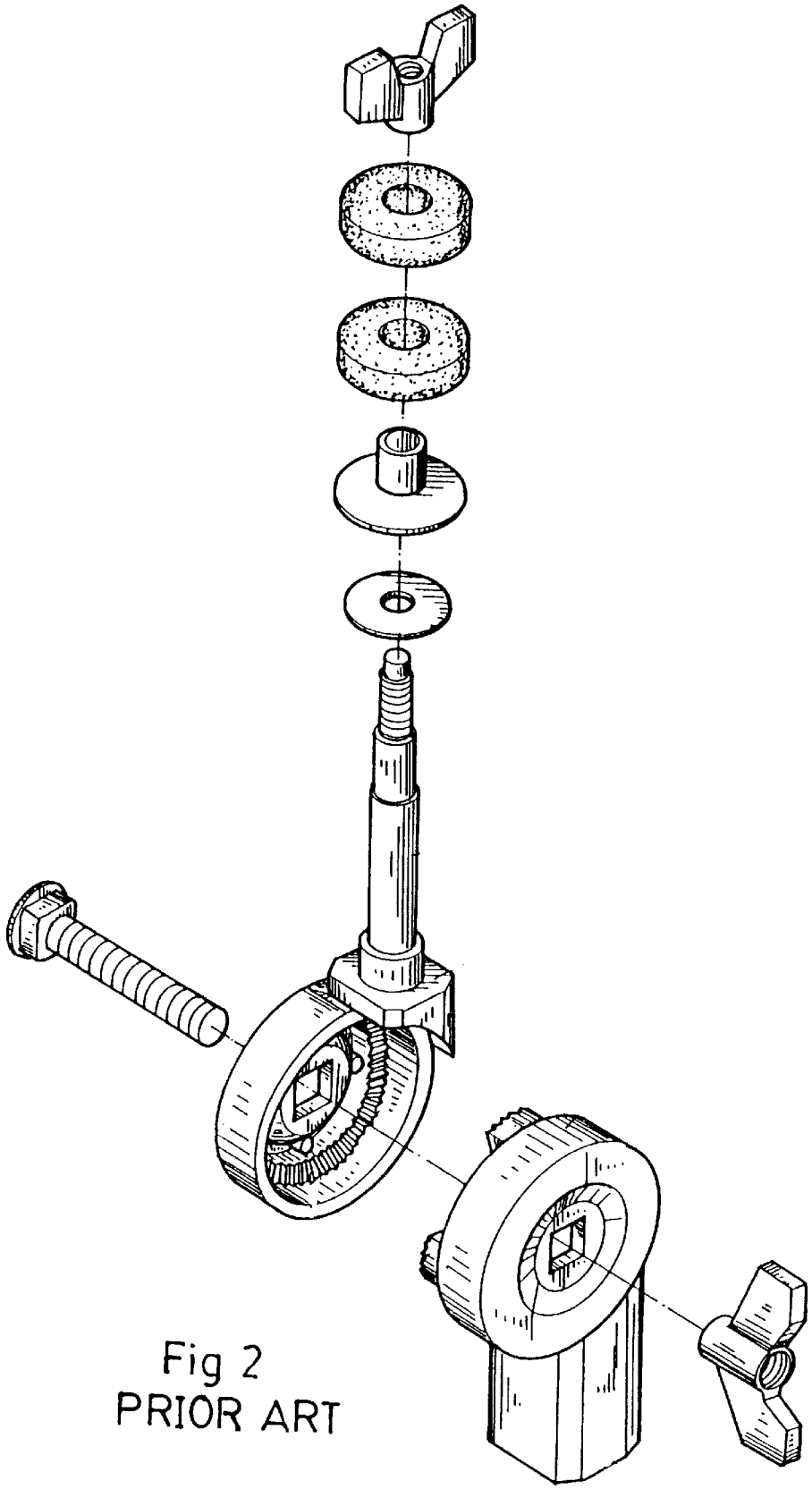
Fig 2 PRIOR ART
FIG. 2 is a three-dimensional exploded view of a conventional cymbal clamp.
Figure 3:
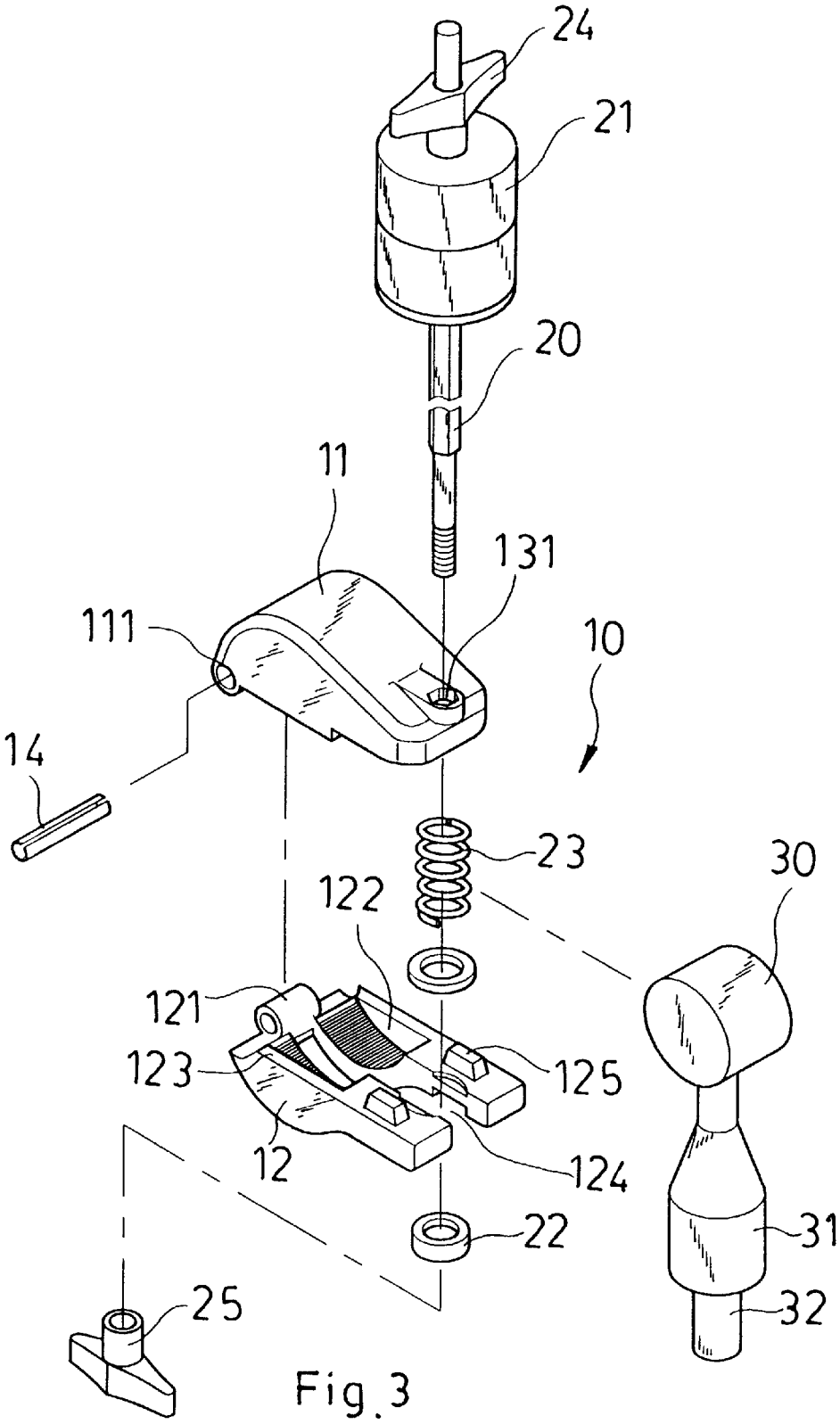
FIG. 3 is a three-dimensional exploded view of this invention.
Figure 4:
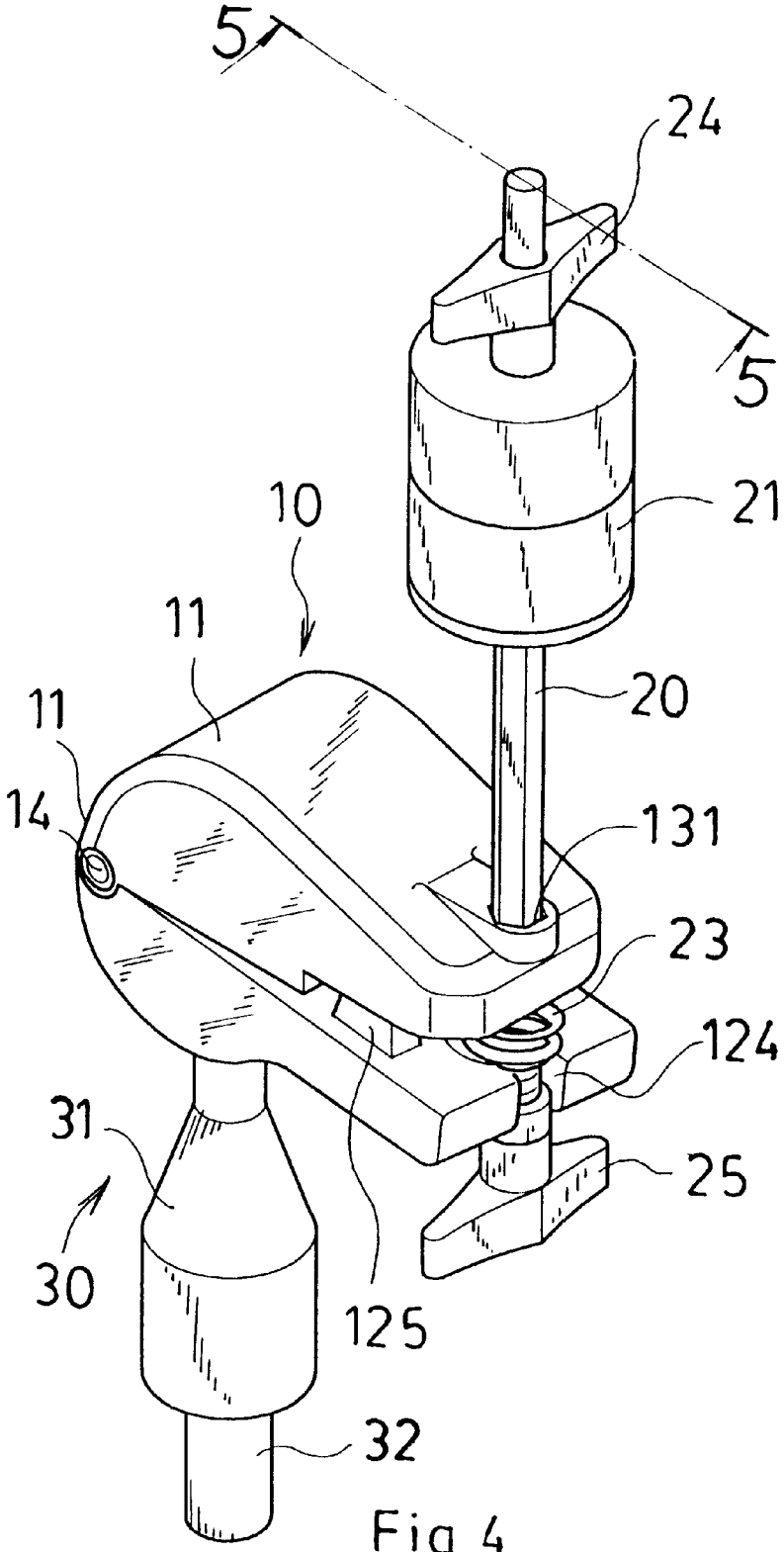
FIG. 4 is a three-dimensional assembled view of this invention.
Figure 5:
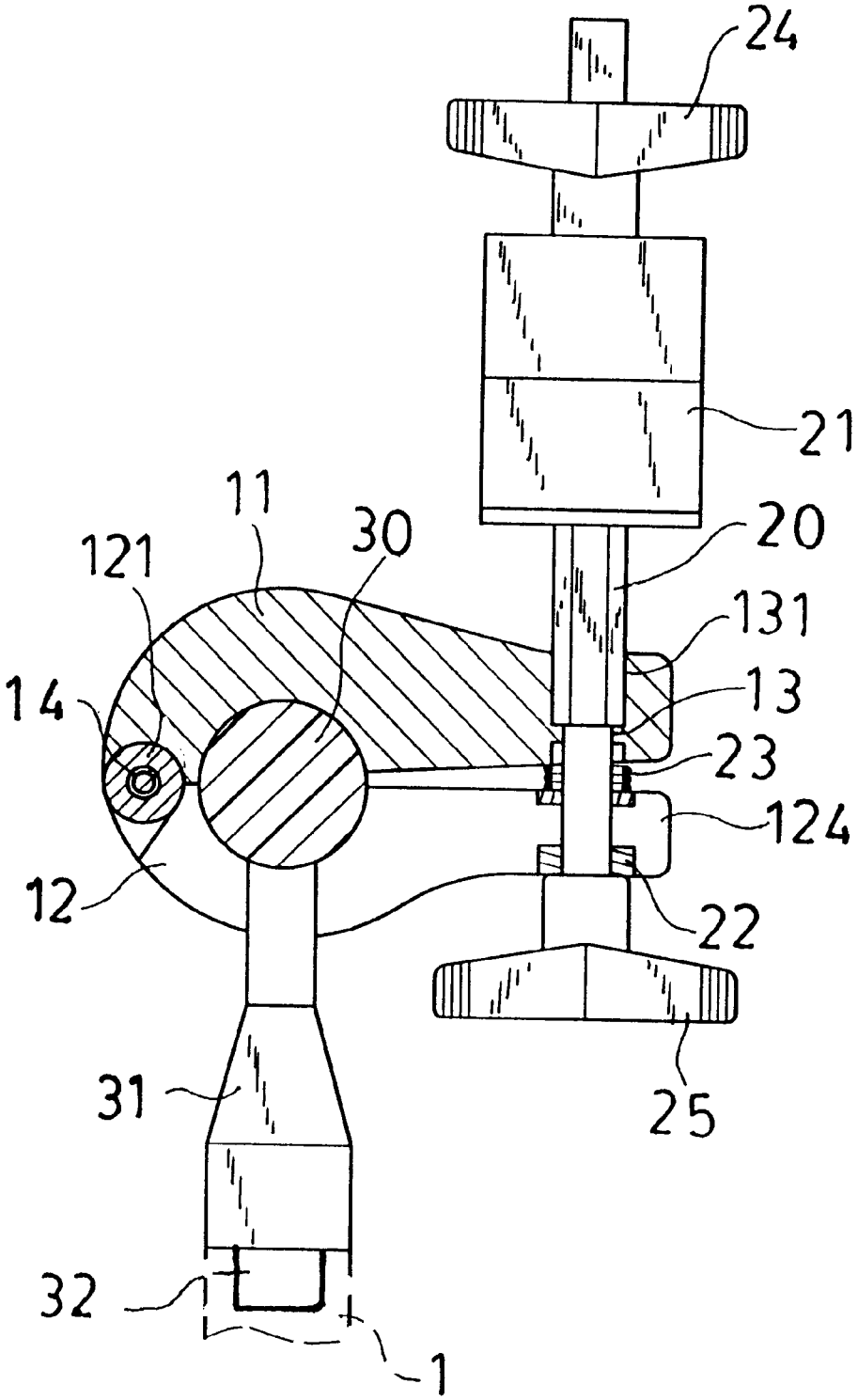
FIG. 5 is a cutaway sectional view taken along line 5—5 in FIG. 4.
Figure 6:
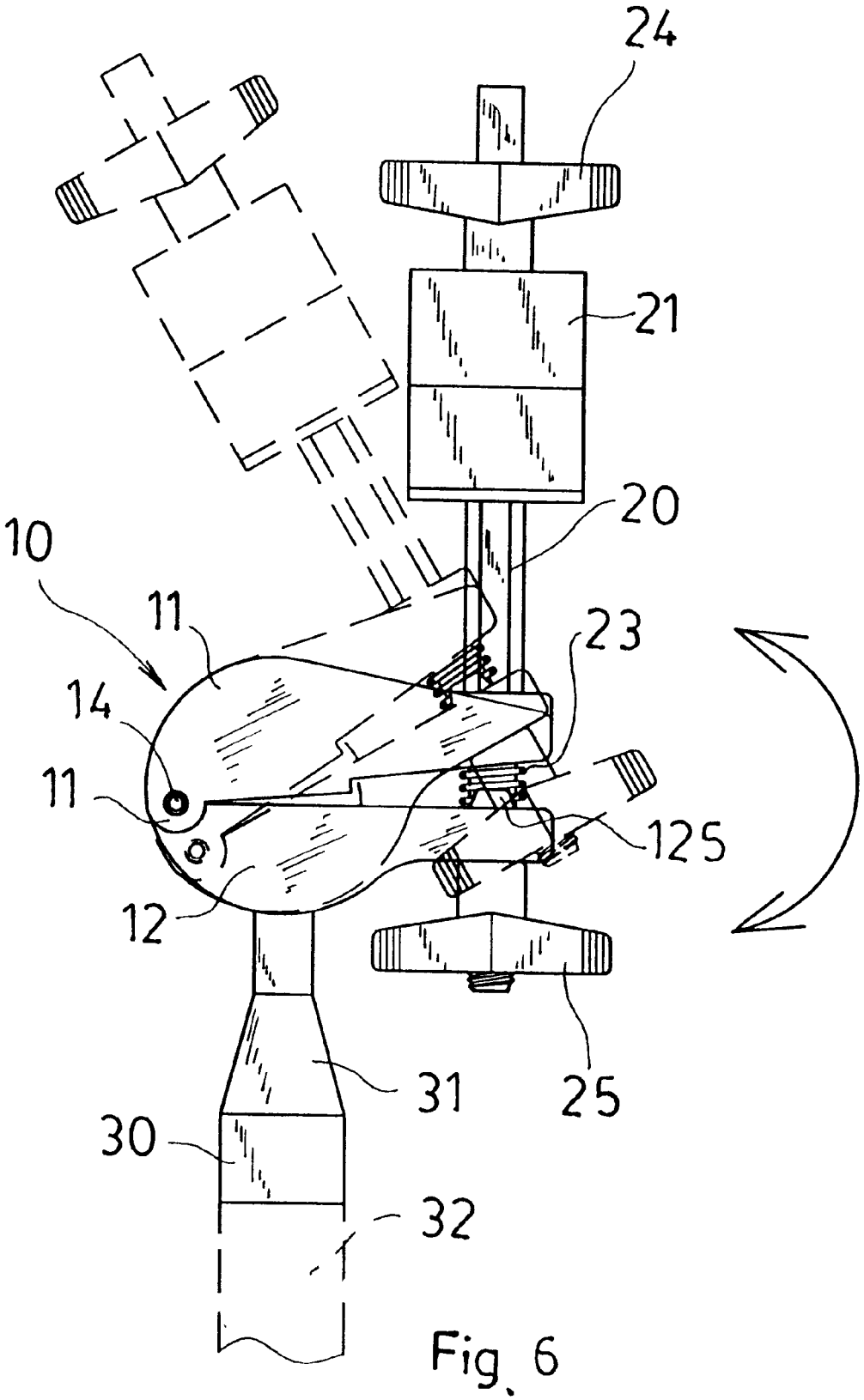
FIG. 6 is an application example of this invention.
Figure 7:
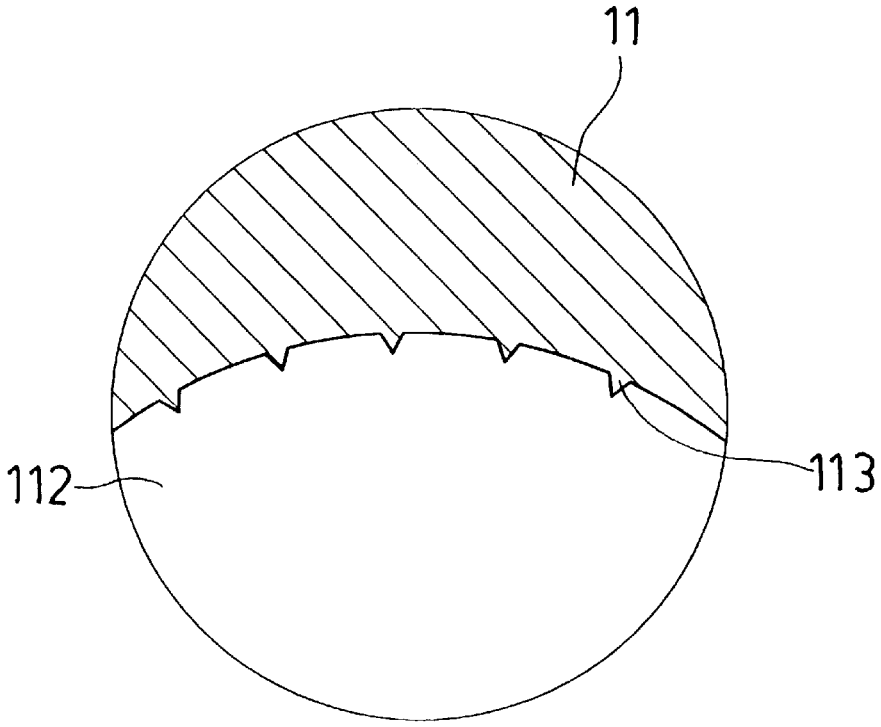
FIG. 7 is an enlarged view showing ratchet teeth in a movable upper clamping piece of this invention.
Figure 8:
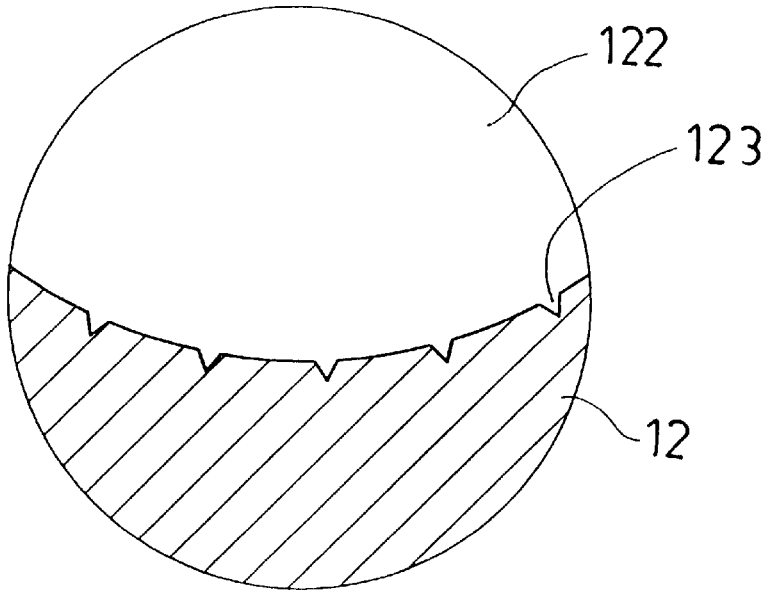
FIG. 8 is an enlarged view showing grooves in a movable lower clamping piece of this invention.

As shown in FIG. 3 through FIG. 8, a cymbal clamp 10 of this invention disposed at top end of a shank 1 comprises an upper movable clamping piece 11, a lower movable clamping piece 12, a hexagonal central post 20, and a barrel pivot rod 30.

A jutting ear 111, 121 is provided to the upper and the lower movable clamping piece 11, 12 respectively at their joint position, and is penetrated with a spring pin 14 for pivotally fixing the movable clamping pieces 11, 12 together so that the combined movable clamping pieces 11, 12 can be opened to a predetermined angle by centering the spring pin 14. Besides, a through hole 13 with a hexagonal hole 131 at its top end is formed at a free end of the upper clamping piece 11, and a semi-circular concavity 112, 122 is formed in inner face of each the upper and the lower clamping piece 11, 12. Further, a plurality of protruding ratchet teeth 113 and correspondent grooves 123 are disposed in inner side of the concavity 112 of the upper clamping piece 11 and in inner side of the concavity 122 of the lower clamping piece 12 respectively. Moreover, a longitudinal open slot 124 having two lateral protruding blocks 125 is formed in the lower clamping piece 12.

The hexagonal central post 20 is plugged in the hexagonal hole 131 of the upper clamping piece 11, wherein a lower end of the central stick 20 is extended into the open slot 124 in the lower clamping piece 12; a plurality of cotton washers 21 is penetratingly located on the central post 20 for sandwiching a cymbal (or cymbal set); a plurality of separation pieces 22 and a spring 23 are penetratingly disposed on the central post 20 in positions between the upper and the lower clamping piece 11, 12; and, both the upper and the lower end of the central post 20 are externally threaded for screw-fixing two wing nuts 24, 25.

The barrel pivot rod 30 is transversely loaded in the concavities 112, 122 and is clamped between the ratchet teeth 113 of the upper clamping piece 11 and the grooves 123 of the lower clamping piece 12, wherein an arrow-shaped central stick 31 is disposed in center of the rim surface of the pivot rod 30; a protruding cylinder 32 with a relatively shorter diameter is arranged at tail end of the central stick 31 for inserting in the shank 1; and the pivot rod 30 and the central stick 31 are formed together by integral molding process.

In assembling abovesaid elements of this invention, the procedure is firstly to plug the protruding cylinder 32 of the pivot rod 30 in the upper end of the shank 1 to form a unity (not shown), then, clamp the pivot rod 30 in the concavities 112, 122, plug the central post 20 in the hexagonal hole 131 and meanwhile have its lower end extended in the open slot 124 of the lower clamping piece 12, penetratingly dispose the plurality of cotton washers 21 on the central post 20 for clamping a cymbal (or cymbal set), then, place the separation pieces 22 and the spring 23 between the upper and the lower clamping piece 11, 12, and finally, screw to fix the wing nuts 24, 25 on the upper and the lower thread portion of the central post 20 respectively.

Whenever adjustment of the inclination angle of a cymbal (or cymbal set) is desired, a user is supposed to turn reversely to loosen the lower wing nut 25 of the central post 20 to enable the ratchet teeth 113 in the upper clamping piece 11 and the grooves 123 in the lower clamping piece 12 to detach from rim surface of the pivot rod 30. After adjustment is made, the user will have to reset the wing nut 25 so that the ratchet teeth 113 and the grooves 123 can cling on to the pivot rod 30 again as usual. In addition, as the rim surface of the pivot rod 30 is smooth and slightly soft, the ratchet teeth 113 and the grooves 123 can clench the pivot rod 30 almost anywhere. In other words, a stepless adjustment of this invention can be done without the defects mentioned in the conventional cymbal clamps.

Although, this invention has been described in terms of preferred embodiments, it is apparent that numerous variations and modifications may be made without departing from the true spirit and scope thereof, as set forth in the following claims.

What is claimed is:

1. A cymbal clamp provided to pinch a cymbal or a cymbal set at top end of a shank, the cymbal clamp comprising:

an upper movable clamping piece and a lower movable clamping piece, wherein two jutting ears are disposed at each said movable clamping piece respectively and pivotally coupled with each other at a joint position of said movable clamping pieces by a spring pin so that the combined movable clamping pieces can be opened to a predetermined angle; and a through hole with a communicable hexagonal hole at its top end is formed at a free end of said upper clamping piece; and a longitudinal open slot formed in said lower clamping piece; and a semi-circular concavity formed in an inner face of each said upper and said lower clamping piece; and a hexagonal central post having a plurality of cotton washers and separation pieces, a spring, and an external thread portion being formed at its top and bottom end respectively for screw joint with two wing nuts;

a barrel pivot rod transversely loaded in said semi-circular concavities, wherein an arrow-shaped central stick is disposed in center of a rim surface of said pivot rod; a protruding cylinder with a relatively shorter diameter is arranged at a tail end of said central stick for inserting in a shank; and the pivot rod and the central stick are formed together to become a unity by integral molding process.

2. The cymbal clamp according to claim 1, wherein a plurality of protruding ratchet teeth and correspondent grooves are disposed in said inner face of said semi-circular concavity of said upper clamping piece and in said inner face of said semi-circular concavity of said lower clamping piece respectively.

3. The cymbal clamp according to claim 1, wherein a protruding block is formed on each of two sides of said longitudinal open slot in said lower clamping piece respectively.

* * * * *